US011912489B2

(12) United States Patent
Ota et al.

(10) Patent No.: US 11,912,489 B2
(45) Date of Patent: Feb. 27, 2024

(54) PACKAGE ACCOMMODATING HEAT DISSIPATION SUBSTRATE AND PACKING BOX

(71) Applicant: DENKA COMPANY LIMITED, Tokyo (JP)

(72) Inventors: Hiroaki Ota, Omuta (JP); Yosuke Ishihara, Omuta (JP); Daisuke Goto, Omuta (JP)

(73) Assignee: DENKA COMPANY LIMITED, Tokyo (JP)

( * ) Notice: Subject to any disclaimer, the term of this patent is extended or adjusted under 35 U.S.C. 154(b) by 226 days.

(21) Appl. No.: 17/292,473

(22) PCT Filed: Nov. 6, 2019

(86) PCT No.: PCT/JP2019/043482
§ 371 (c)(1),
(2) Date: May 10, 2021

(87) PCT Pub. No.: WO2020/100686
PCT Pub. Date: May 22, 2020

(65) Prior Publication Data

US 2022/0017282 A1 Jan. 20, 2022

(30) Foreign Application Priority Data

Nov. 14, 2018 (JP) ..... 2018-213469

(51) Int. Cl.
*B65D 85/48* (2006.01)
*B65D 81/26* (2006.01)
(Continued)

(52) U.S. Cl.
CPC ..... *B65D 81/268* (2013.01); *B65D 57/004* (2020.05); *B65D 81/203* (2013.01)

(58) Field of Classification Search
CPC ..... B65D 51/30; B65D 57/004; B65D 81/26; B65D 81/203; B65D 81/268; B65D 85/48
(Continued)

(56) References Cited

U.S. PATENT DOCUMENTS 4,069,348 A 1/1978 Bush
5,510,166 A 4/1996 Inoue et al.
(Continued)

FOREIGN PATENT DOCUMENTS

CN 102161404 A 8/2011
CN 108349642 A 7/2018
(Continued)

OTHER PUBLICATIONS

Jp2007269391, Patent Translate Powered by EPO and Google, 10 pages, Oct. 18, 2007.*
(Continued)

*Primary Examiner* — Luan K Bui
(74) *Attorney, Agent, or Firm* — Oliff PLC

(57) ABSTRACT

A plurality of heat dissipation substrates stacked on each other, intermediate sheets disposed under a lowermost heat dissipation substrate, on an uppermost heat dissipation substrate, and between heat dissipation substrates adjacent to each other, a drying agent disposed over or under the plurality of heat dissipation substrates, and a bag that seals the plurality of heat dissipation substrates, the plurality of intermediate sheets, and the drying agent.

11 Claims, 2 Drawing Sheets

(51) Int. Cl.
*B65D 57/00* (2006.01)
*B65D 81/20* (2006.01)

(58) Field of Classification Search
USPC ..... 206/204, 434, 454, 710
See application file for complete search history.

(56) References Cited

U.S. PATENT DOCUMENTS

| | | | | |
|---|---|---|---|---|
| 8,293,348 | B2 | 10/2012 | Yuno et al. | |
| 10,815,039 | B2 | 10/2020 | Yamauchi et al. | |
| 2005/0098473 | A1* | 5/2005 | Sheehan | H01L 21/67369 206/832 |
| 2005/0194279 | A1* | 9/2005 | Coppola | B65D 85/48 206/454 |
| 2006/0237343 | A1* | 10/2006 | Fuyumuro | H01L 21/67132 206/710 |
| 2007/0193906 | A1* | 8/2007 | Cornelius | B65D 81/113 206/600 |
| 2009/0095650 | A1* | 4/2009 | Pylant | H01L 21/67379 206/710 |
| 2010/0296757 | A1 | 11/2010 | Yuno et al. | |
| 2012/0237791 | A1 | 9/2012 | Lin | |
| 2013/0240398 | A1* | 9/2013 | Garner | B65D 57/004 206/454 |
| 2014/0034548 | A1* | 2/2014 | Pylant | H01L 21/67369 206/710 |
| 2014/0209488 | A1* | 7/2014 | Dai | B65D 81/268 206/204 |
| 2018/0346214 | A1 | 12/2018 | Yamauchi et al. | |

FOREIGN PATENT DOCUMENTS

| | | | |
|---|---|---|---|
| JP | H01-202436 | A | 8/1989 |
| JP | H05-051072 | A | 3/1993 |
| JP | H11-116361 | A | 4/1999 |
| JP | H11-139889 | A | 5/1999 |
| JP | 3112546 | U | 8/2005 |
| JP | 2007-269391 | A | 10/2007 |
| JP | 2007-314236 | A | 12/2007 |
| JP | 2009-096155 | A | 5/2009 |
| JP | 2015-161026 | A | 9/2015 |
| JP | 2017-132480 | A | 8/2017 |
| TW | 201613761 | A | 4/2016 |
| WO | 2004/000541 | A1 | 12/2003 |
| WO | 2017/164352 | A1 | 9/2017 |

OTHER PUBLICATIONS

Nov. 30, 2021 Extended Search Report issued in European Patent Application No. 19885905.0.
Nov. 1, 2022 Office Action and Search Report issued in Chinese Patent Application No. 201980074306.2.
Penna, "Wood Packaging System Design with Mechantronics Products", Printing Industry Press, p. 384, Oct. 1, 2014.
Jul. 26, 2022 Office Action and Search Report issued in Chinese Patent Application No. 201980074306.2.
Feb. 4, 2020 International Search Report issued in International Patent Application No. PCT/JP2019/043482.
May 5, 2023 Office Action issued in Taiwanese Patent Application No. 108140756.

* cited by examiner

PACKAGE ACCOMMODATING HEAT DISSIPATION SUBSTRATE AND PACKING BOX

TECHNICAL FIELD

The present invention relates to a package accommodating a heat dissipation substrate and a packing box.

BACKGROUND ART

A variety of methods for storing a substrate have been developed so far. As this type of technique, for example, a technique described in Japanese Unexamined Patent Publication No. H5-51072 is known. Japanese Unexamined Patent Publication No. H5-51072 describes a method in which a drying member and a single circuit board are sealed in a resin bag.

SUMMARY OF THE INVENTION

However, as a result of the present inventors' studies, it has been found that the method for storing a single substrate described in Japanese Unexamined Patent Publication No. H5-51072 has room for improvement in the transporting property and the preserving property of a plurality of heat dissipation substrates.

As a result of additional studies, the present inventors have found that a package accommodating only a single heat dissipation substrate becomes bulky in a packing box, which causes a decrease in the packing density of the heat dissipation substrate and degrades the transporting property of a plurality of heat dissipation substrates. However, in packages accommodating a plurality of heat dissipation substrates, there is a concern that substrate damage may be caused in the heat dissipation substrates due to contact between the substrates, an external force exerted during the operation of a packing work or during transportation, or the like.

As a result of additional intensive studies based on such knowledge, it was found that, in a package accommodating a plurality of stacked heat dissipation substrates, when intermediate sheets are disposed under the lowermost heat dissipation substrate, on the uppermost heat dissipation substrate, and between heat dissipation substrates adjacent to each other, respectively, it is possible to suppress the occurrence of substrate damage while improving the transporting property of the heat dissipation substrates.

According to the present invention, provided is a package including

- a plurality of heat dissipation substrates stacked on each other,
- intermediate sheets disposed under a lowermost heat dissipation substrate, on an uppermost heat dissipation substrate, and between heat dissipation substrates adjacent to each other,
- a drying agent disposed over or under the plurality of heat dissipation substrates, and
- a bag that seals the plurality of heat dissipation substrates, the plurality of intermediate sheets, and the drying agent.

In addition, according to the present invention, provided is a packing box including

- a plurality of the packages, and
- a cushioning material.

According to the present invention, a package being excellent in terms of the transporting property and the preserving property of a heat dissipation substrate and a packing box including the package are provided.

BRIEF DESCRIPTION OF THE DRAWINGS

The above-described object, other objects, features, and advantages will be further clarified by a preferred embodiment described below and the accompanying drawings below.

DESCRIPTION OF EMBODIMENTS

Figure 1:
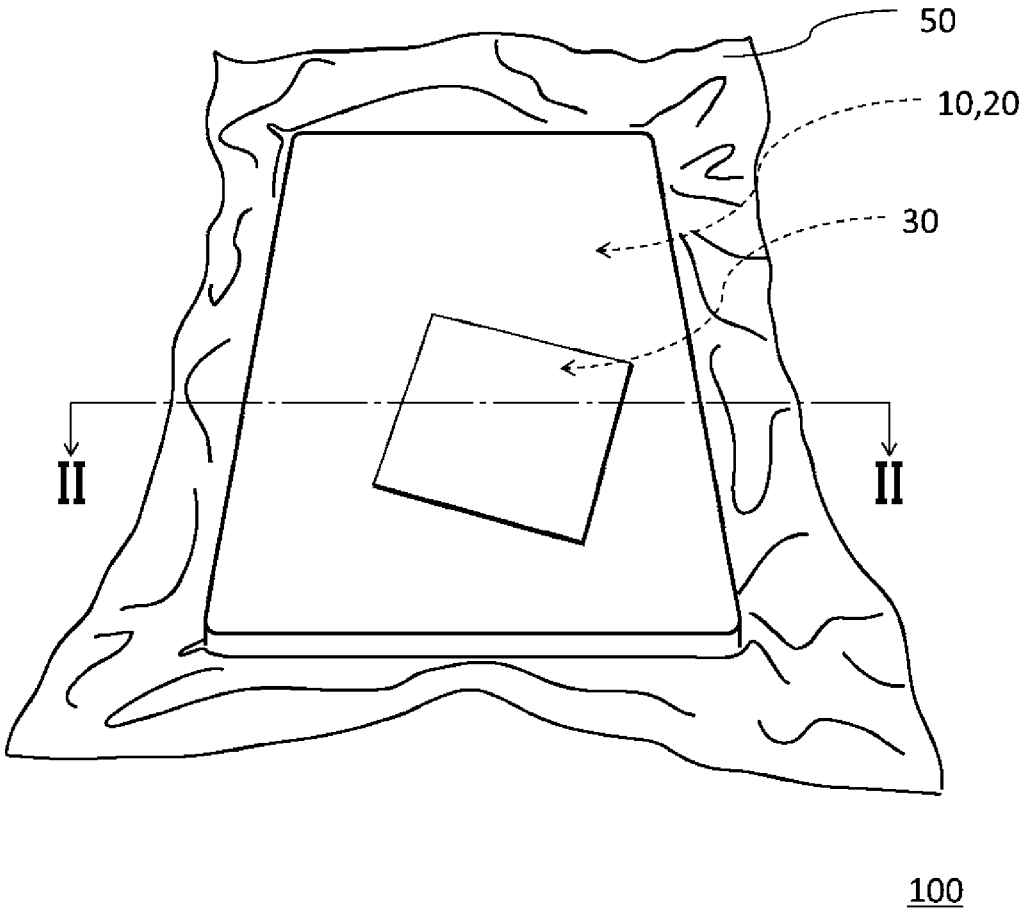
FIG. 1 is a schematic view showing an example of the configuration of a package of the present embodiment.

Hereinafter, an embodiment of the present invention will be described using drawings. It should be noted that, in all of the drawings, the same configuration element will be given the same reference sign and description thereof will not be repeated. In addition, the drawings are schematic views and do not match actual dimensional ratios.

It should be noted that the present embodiment will be described by specifying front, rear, left, right, upper, and lower directions as shown in the drawings. However, these directions are specified for convenience in order to briefly describe the relative relationships between the configuration elements. Therefore, such directions do not specify directions used during the manufacturing or using of products on which the present invention is carried out.

The outline of a package of the present embodiment will be described.

The package of the present embodiment includes a plurality of heat dissipation substrates stacked on each other, intermediate sheets disposed under a lowermost heat dissipation substrate, on an uppermost heat dissipation substrate, and between heat dissipation substrates adjacent to each other, a drying agent disposed over or under the plurality of heat dissipation substrates, and a bag that seals the plurality of heat dissipation substrates, the plurality of intermediate sheets, and the drying agent.

According to the present embodiment, transportation of the package in which the plurality of heat dissipation substrates is sealed in the bag in an overlapped state increases the packing density of the heat dissipation substrates and makes it possible to increase the transportation efficiency of the heat dissipation substrates.

However, in recent years, the demanding standard for the characteristics of heat dissipation substrates has risen, and heat dissipation substrates have been demanded to have a high-level preserving property. For example, there is a concern that substrate damage caused during transportation or during packing may have a large influence on the characteristics or durability of heat dissipation substrates due to repeated application of thermal stress attributed to thermal cycles. In addition, there is a concern that the characteristics of heat dissipation substrates may degrade in the case of being exposed to external environments such as oxygen or water.

In contrast, according to the present embodiment, the intermediate sheets are disposed not only between the heat dissipation substrates adjacent to each other but also under the lowermost heat dissipation substrate and on the uppermost heat dissipation substrate, whereby it is possible to protect a portion in which substrate damage is likely to be caused in the plurality of stacked heat dissipation substrates with the intermediate sheets. Therefore, it is possible to suppress substrate damage that is caused in the plurality of heat dissipation substrates during transportation or during packing.

In addition, the plurality of heat dissipation substrates is sealed in the bag together with the drying agent. Therefore, it is possible to suppress the degradation of the characteristics of the heat dissipation substrates due to moisture.

Since the package of the present embodiment is capable of suppressing the deterioration of the substrates due to substrate damage, moisture, or the like while enhancing the transporting property of the heat dissipation substrates, it is possible to improve the preserving property of the plurality of stacked heat dissipation substrates.

Hereinafter, the detailed configuration of the package of the present embodiment will be described based on FIGS. 1 and 2.

FIG. 1 is a schematic view showing an example of the configuration of a package 100. FIG. 2 is a cross-sectional view taken along an arrow II-II of the package 100 in FIG. 1 and a schematic view showing an example of the laminate structure in the package 100.

The package 100 in FIG. 1 is made of a bag 50 accommodating a plurality of heat dissipation substrates 10, a plurality of intermediate sheets 20, and a drying agent 30 in a stacked state. The bag 50 seals the heat dissipation substrates 10, the intermediate sheets 20, and the drying agent 30 and is capable of suppressing these members moving in a direction orthogonal to the stacking direction inside the bag 50.

The bag 50 is made of an aluminum laminated film or a resin film. An aluminum laminated film having a low water vapor permeability or oxygen permeability is preferably used. Therefore, the airtightness of the bag 50 can be enhanced.

The aluminum laminated film may be a laminated film in which an aluminum layer and a resin layer are laminated together. It should be noted that the bag 50 may contain, in addition to aluminum or a resin, another material for the purpose of enhancing the gas barrier property and decreasing the water vapor permeability.

As the aluminum layer in the aluminum laminated film, for example, an aluminum foil or an aluminum-deposited layer is used. As an aluminum material, it is possible to use, in addition to pure aluminum, an Al—Mn-based, Al—Mg-based, or Al—Fe-based aluminum alloy.

Examples of the resin layer in the aluminum laminated film include resin layers containing polyethylene (PE), polypropylene (PP), polyethylene terephthalate (PET), polyvinyl chloride (PVC), polyvinylidene chloride (PVDC), a polyethylene chloride resin (SPE), a nylon resin, or the like. Such a resin layer is capable of improving the gas barrier property of the bag 50. The resin layer may be used singly or two or more resin layers may be used in combination. In the innermost layer of the bag 50, a resin layer having an excellent thermal fusion property is preferably provided as a heat sealing layer.

In the bag 50, a plurality of aluminum layers and resin layers may be laminated. The bag 50 can be configured such that one or more resin layers are laminated on both sides of the aluminum layer. The number of layers laminated in the bag 50 may be set to, for example, equal to or more than 3 and equal to or less than 10.

The aluminum layer and the resin layer can be caused to adhere to each other by a well-known method, but may also be caused to adhere to each other by thermal compression or using an adhesive. As the adhesive, a thermosetting adhesive or ultraviolet-curable adhesive is used.

The water vapor permeability of the bag 50, which is measured in accordance with JIS Z 0222: 1959 (temperature of 40° C. and relative humidity of 90%), is, for example, equal to or more than 0.1 $g/m^2 \cdot day$ and equal to or less than 15.0 $g/m^2 \cdot day$, more preferably equal to or more than 0.2 $g/m^2 \cdot day$ and equal to or less than 10.0 $g/m^2 \cdot day$, and still more preferably equal to or more than 0.3 $g/m^2 \cdot day$ and equal to or less than 5.0 $g/m^2 \cdot day$. With the water vapor permeability set within such a numerical range, the preserving property of the heat dissipation substrates 10 can be improved.

The oxygen permeability of the bag 50, which is measured in accordance with JIS K 7126-2: 2006 (temperature of 20° C. and relative humidity of 90%), is, for example, equal to or more than 0.1 $cm^3/(m^2 \cdot 24\ h \cdot atm)$ and equal to or less than 50.0 $cm^3/(m^2 \cdot 24\ h \cdot atm)$, preferably equal to or more than 0.3 $cm^3/(m^2 \cdot 24\ h \cdot atm)$ and equal to or less than 45.0 $cm^3/(m^2 \cdot 24\ h \cdot atm)$, and more preferably equal to or more than 0.8 $cm^3/(m^2 \cdot 24\ h \cdot atm)$ and equal to or less than 30.0 $cm^3/(m^2 \cdot 24\ h \cdot atm)$. With the oxygen permeability set within such a numerical range, the preserving property of the heat dissipation substrates 10 can be improved.

As the resin film that configures the bag 50, for example, one or more resin layers exemplified above can be used. As the resin film, it is possible to use a composite resin film of a resin having an excellent heat sealing property and a resin having a relatively low gas permeability with respect to oxygen or the like. As the bag 50 made of the resin film, for example, a nylon bag in which nylon is laminated on polyethylene may be used. The nylon bag is heat-sealable, has a low oxygen permeability compared with pure polyethylene, and is transparent. The use of a transparent bag 50 enables the visual inspect of the inside of the bag.

The bag 50 can be antistatic. In an antistatic bag 50, for example, an antistatic agent may be contained in the film that configures the bag 50 or may be imparted on the surface of the film.

The bag 50 is for vacuum packaging or gas exchange packaging. Therefore, it is possible to suppress the oxidation deterioration of the heat dissipation substrates 10.

The inside of the bag 50 for vacuum packaging can be put into a vacuum state by degassing the air such as oxygen.

In addition, in the inside of the bag 50 for gas exchange packaging, the air may be removed and substituted by an inert gas. The inert gas is not particularly limited as long as the gas does not react with the heat dissipation substrates, and examples thereof include nitrogen gas, argon gas, and the like. The inside of the bag 50 for gas exchange packaging is put into a depressurized state.

The thickness of the bag 50 is not particularly limited and is equal to or more than 50 μm and equal to or less than 300 μm, more preferably equal to or more than 55 μm and equal to or less than 200 μm, and still more preferably equal to or more than 65 μm and equal to or less than 100 m. With the thickness of the bag 50 set to equal to or more than the above-described lower limit value, it is possible to improve the mechanical strength or gas barrier property of the bag 50. With the thickness of the bag 50 set to equal to or less than the above-described upper limit value, the handleability of the bag 50 improves, for example, it is possible to facilitate the bending of the heat-sealed end portion of the bag 50 at the time of packing.

The shape of the bag 50 may have a structure following the outer shape of the heat dissipation substrate 10 when the heat dissipation substrate 10 is viewed in the stacking direction and becomes, for example, a substantially rectangular shape.

The size of the bag 50 can be appropriately selected depending on the sizes of the heat dissipation substrates 10 to be accommodated and the number of the heat dissipation substrates 10 laminated.

As the form of the bag 50, for example, a three-side sealed bag, a four-side sealed bag, or the like is used. That is, when viewed in the stacking direction, the bag 50 having a substantially rectangular shape is heat-sealed at three end portions or four end portions (top, bottom, right, and left). For example, in the case of a four-side sealed bag, the bag 50 viewed in the stacking direction may have heat sealing portions at end portions that cover the entire periphery of an accommodation region in which the heat dissipation substrates 10 are accommodated outside the accommodation region. These heat sealing portions are capable of protecting the side surfaces of the heat dissipation substrates 10 accommodated in the bag 50.

It be noted that the heat sealing portion is a portion in which a front surface material and a rear surface material that are made of an aluminum laminated film or a resin film are superimposed and thermally fused together.

A label displaying a variety of information can be imparted on the surface of the bag 50. The label may be directly printed or may be caused to adhere as a printed matter on the surface of the bag 50.

The heat dissipation substrate 10 can be made of a plate-like substrate made of a metal-silicon carbide composite in which a silicon carbide porous material is impregnated with metal containing anyone of aluminum and magnesium.

The heat dissipation substrate 10 has a substantially rectangular flat plate shape. The heat dissipation substrate 10 has a substantially rectangular flat plate shape when one main surface of the heat dissipation substrate 10 is defined as the upper surface and the upper surface is viewed from above. The heat dissipation substrate 10 typically includes metal portions at the four corners.

The thickness of the heat dissipation substrate 10 is, for example, equal to or more than 1 mm and equal to or less than 10 mm and preferably equal to or more than 3 mm and equal to or less than 5 mm.

The number of the heat dissipation substrates 10 laminated is, for example, equal to or more than two and equal to or less than six and preferably equal to or more than three and equal to or less than five. With the number of the heat dissipation substrates 10 laminated set within such a numerical range, it is possible to suppress the occurrence of substrate damage attributed to the weight of the heat dissipation substrate 10 while improving the transporting property.

The intermediate sheet 20 is not particularly limited as long as one is bendable without adhering to the heat dissipation substrate 10 and functions as a cushioning material. The intermediate sheet 20 can be made of, for example, a paper-based base material, a metal foil, or a resin base material.

Examples of the paper-based base material include clean paper, kraft paper, Japanese paper, glassine paper, high-quality paper, synthetic paper, top-coated paper, and the like.

Examples of the metal foil include an aluminum foil and the like.

In addition, as the resin base material, a resin sheet formed of a resin material such as polypropylene, polyethylene, or polyvinyl chloride is used.

The thickness of the intermediate sheet 20 is, for example, equal to or more than 0.01 mm and equal to or less than 0.1 mm. With the thickness of the intermediate sheet 20 set within such a numerical range, it is possible to balance the mechanical strength and the flexibility.

The size of the intermediate sheet 20 may be substantially the same as the size of the heat dissipation substrate 10 or slightly larger than the size of the heat dissipation substrate 10 when viewed in the stacking direction. In such a case, it is possible to suppress the stacked heat dissipation substrates 10 coming into contact with each other.

Figure 2:
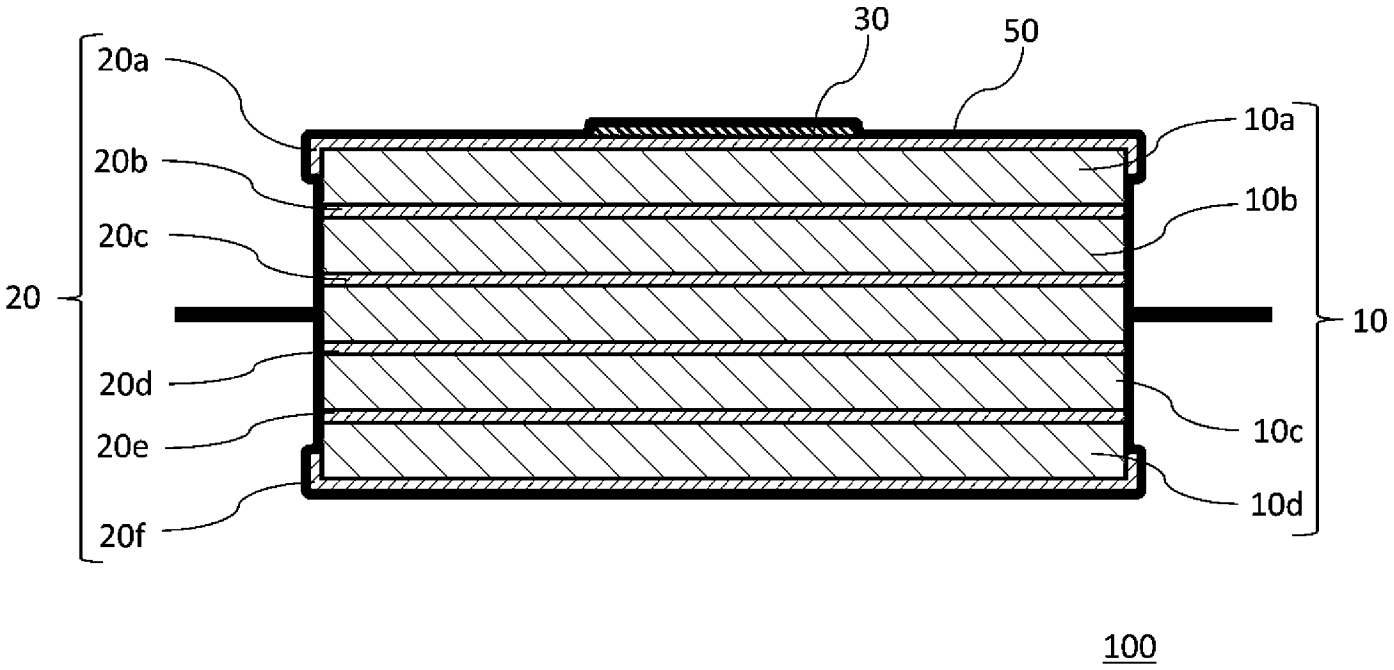
FIG. 2 is a cross-sectional view taken along an arrow II-II of the package in FIG. 1.

An intermediate sheet 20*a* disposed on an uppermost heat dissipation substrate 10*a* can be configured to cover side surfaces of at least one heat dissipation substrate 10*a* together with the entire upper surface of the heat dissipation substrate 10*a* as shown in FIG. 2. The intermediate sheet 20*a* may cover not only the side surface of the heat dissipation substrate 10*a* but also the side surface of a heat dissipation substrate 10*b* that is positioned under the heat dissipation substrate 10*a* or the side surface of a lowermost heat dissipation substrate 10*d*. In addition, an intermediate sheet 20*b* disposed between the heat dissipation substrate 10*a* and the heat dissipation substrate 10*b* may be configured to cover the side surface of the heat dissipation substrate 10*b*. Therefore, the intermediate sheets 20 are capable of protecting the side surfaces of the heat dissipation substrates 10 and suppressing breakage of the heat dissipation substrates 10.

In addition, the intermediate sheet 20*a* is capable of covering not only the side surface of the heat dissipation substrate 10*a* but also a corner portion of the heat dissipation substrate 10*a*. Examples of the corner portion include a first corner portion in which the upper surface and a side surface of the heat dissipation substrate 10*a* intersect, a second corner portion in which two side surfaces intersect, and a third corner portion in which the upper surface and the two side surfaces intersect. As described above, the intermediate sheets 20 are capable of covering the corner portions of the heat dissipation substrates 10. The corner portion is a part to which an external force is likely to be applied locally. Therefore, the intermediate sheets 20 are capable of suppressing breakage of the corner portions of the heat dissipation substrates 10.

The drying agent 30 is disposed over or under the plurality of heat dissipation substrates 10. The drying agent 30 can be used as a label that is visually or tactilely recognizable on the front or rear surface of the heat dissipation substrates 10 covered with the heat dissipation substrate 10 in the package 100.

The drying agent 30 can be made of a sheet member having a moisture absorption characteristic. The thickness of the drying agent 30 may be set to, for example, equal to or more than 0.1 mm and equal to or less than 5.0 mm. Stress applied to the heat dissipation substrate 10 from the drying agent 30 after sealing can be suppressed by thinning the drying agent 30. The moisture absorption property of the drying agent 30 can be enhanced by thickening the drying agent 30.

The shape of the drying agent 30 may be, for example, a rectangular shape, a square shape, or a circular shape when viewed in the stacking direction. The size of the drying agent 30 may be substantially the same as or smaller than the size of the heat dissipation substrate 10 when viewed in the stacking direction.

Examples of a moisture absorption material that is used for the drying agent 30 include an inorganic material, a water absorption polymer, a material obtained by combining an inorganic material and a water absorption polymer, and the like. As the inorganic material, a well-known inorganic material is used, and examples thereof include lime (calcium oxide and calcium hydroxide), silica gel, calcium chloride, zeolite, lithium chloride, and the like. As the water absorption polymer, a well-known water absorption polymer can be used. The moisture absorption material may be used singly or two or more moisture absorption materials may be used in combination.

In addition, the drying agent 30 may have a structure in which films are formed on both surfaces of a sheet base material made of a moisture absorption material or a composite sheet base material containing a moisture absorption material and another component such as a resin, respectively. This makes it possible to prevent the erroneous adhesion of the moisture absorption material to the heat dissipation substrate 10. As the film, a material having a certain level of high water vapor permeability is used.

Hereinafter, a method for manufacturing the package 100 of the present embodiment will be described.

The following method for manufacturing the package 100 is an example, and a variety of other steps may be adopted.

A plurality of the heat dissipation substrates 10, a plurality of the intermediate sheets 20, and the drying agent 30 are prepared.

The heat dissipation substrates 10 and the intermediate sheets 20 are alternately overlapped, the heat dissipation substrates 10 and the intermediate sheets 20 shown in FIG. 2 are laminated together, and the drying agent 30 is placed on the top portion, thereby obtaining a laminated body.

The obtained laminated body is disposed between the front surface material and the rear surface material of an aluminum laminated film that configure the bag 50.

The inside of the bag 50 is put into a vacuum state by degassing, and end portions in which the front surface material and the rear surface material overlap are heat-sealed.

As a result, the package 100 in FIG. 1 is obtained.

Hereinafter, a packing box of the present embodiment will be described.

The packing box of the present embodiment includes a plurality of the packages 100 and a cushioning material provided in at least a part of the periphery of the packages 100 in a box.

The transportation efficiency of the packages 100 can be enhanced by transporting the packing box including the plurality of packages 100.

The box is made of, for example, a cardboard box, a plastic case, or the like.

As the cushioning material, a well-known cushioning material can be used.

The packages 100 can be individually packed using a sheet-like cushioning material such as a foamed polyethylene sheet.

A space between the packages 100 and the bottom surface or side surface of the box or a space in the box can be filled using a sheet-like or granular cushioning material such as Styrofoam or polyurethane.

The plurality of packages 100 packed with the sheet-like cushioning material can be disposed side by side such that the stacking direction becomes parallel to the bottom surface of the box. Therefore, it is possible to efficiently accommodate the packages 100 in the box while suppressing breakage of the packages 100 compared with a case where the plurality of packages 100 is flatly stacked in the stacking direction.

Hereinafter, examples of reference forms will be added.

1. A package including:
   a plurality of heat dissipation substrates stacked on each other,
   intermediate sheets disposed under a lowermost heat dissipation substrate, on an uppermost heat dissipation substrate, and between heat dissipation substrates adjacent to each other,
   a drying agent disposed over or under the plurality of heat dissipation substrates, and
   a bag that seals the plurality of heat dissipation substrates, the plurality of intermediate sheets, and the drying agent,
   in which the drying agent is made of a sheet member having a moisture absorption characteristic and has a thickness of equal to or more than 0.1 mm and equal to or less than 5.0 mm.
2. The package according to 1.,
   in which a water vapor permeability of the bag, which is measured in accordance with JIS Z 0222: 1959 (temperature of 40° C. and relative humidity of 900), is equal to or more than 0.1 $g/m^2 \cdot day$ and equal to or less than 15.0 $g/m^2 \cdot day$.
3. The package according to 1. or 2.,
   in which an oxygen permeability of the bag, which is measured in accordance with JIS K 7126-2: 2006 (temperature of 20° C. and relative humidity of 90%), is equal to or more than 0.1 $cm^3/(m^2 \cdot 24\ h \cdot atm)$ and equal to or less than 50.0 $cm^3/(m^2 \cdot 24\ h \cdot atm)$.
4. The package according to any one of 1. to 3.,
   in which the heat dissipation substrate is a plate-like substrate made of a metal-silicon carbide composite in which a silicon carbide porous material is impregnated with metal containing any one of aluminum and magnesium.
5. The package according to any one of 1. to 4.,
   in which the bag is made of an aluminum laminated film.
6. The package according to any one of 1. to 5.,
   in which the intermediate sheet is a paper-based base material.
7. The package according to any one of 1. to 6.,
   in which the intermediate sheet disposed on the uppermost heat dissipation substrate covers side surfaces of at least one heat dissipation substrate.
8. The package according to any one of 1. to 7.,
   in which the number of the heat dissipation substrates laminated is equal to or more than two and equal to or less than six.
9. The package according to any one of 1. to 8.,
   in which an end portion of the bag is heat-sealed.
10. The package according to any one of 1. to 9.,
   in which the bag seals the plurality of heat dissipation substrates, the plurality of intermediate sheets, and the drying agent in a vacuum state.
11. The package according to any one of 1. to 10.,
   in which a shape of the drying agent is a rectangular shape, a square shape, or a circular shape when viewed in a stacking direction.
12. The package according to any one of 1. to 11.,
   in which the drying agent has a structure in which films are formed on both surfaces of a sheet base material made of a moisture absorption material or a composite sheet base material containing a moisture absorption material and another component such as a resin, respectively.

The invention according to the above 1. has a configuration in which a sheet-like drying agent is disposed over or under the plurality of heat dissipation substrates, that is, disposed in the vertical direction. The sheet-like drying agent disposed in the vertical direction suppresses the lateral movement of the drying agent between the inner surface of the bag and the substrates in the bag in a sealed state, which makes it possible to suppress damage to the surface of a substrate or the inner surface of the bag, which may be caused by the positional deviation of the drying agent during the transportation or the like.

Hitherto, the embodiment of the present invention has been described, but the embodiment is an example of the present invention, and it is also possible to adopt a variety of configurations other than the above-described configuration.

Priority is claimed on Japanese Patent Application No. 2018-213469, filed Nov. 14, 2018, the content of which is incorporated herein by reference.

The invention claimed is:

1. A package comprising:

a plurality of heat dissipation substrates stacked on each other;

intermediate sheets disposed under a lowermost heat dissipation substrate, on an uppermost heat dissipation substrate, and between heat dissipation substrates adjacent to each other;

a sheet drying agent disposed over or under the plurality of heat dissipation substrates; and a bag that seals the plurality of heat dissipation substrates, the plurality of intermediate sheets, and the sheet drying agent in a stacked state.

2. The package according to claim 1, wherein a water vapor permeability of the bag, which is measured in accordance with JIS Z 0222: 1959, is equal to or more than 0.1 $g/m^2 \cdot day$ and equal to or less than 15.0 $g/m^2 \cdot day$.

3. The package according to claim 1, wherein an oxygen permeability of the bag, which is measured in accordance with JIS K 7126-2: 2006, is equal to or more than 0.1 $cm^3/(m^2 \cdot 24\ h \cdot atm)$ and equal to or less than 50.0 $cm^3/(m^2 \cdot 24\ h \cdot atm)$.

4. The package according to claim 1, wherein the heat dissipation substrate is a plate-like substrate made of a metal-silicon carbide composite in which a silicon carbide porous material is impregnated with metal containing any one of aluminum and magnesium.

5. The package according to claim 1, wherein the bag is made of an aluminum laminated film.

6. The package according to claim 1, wherein the intermediate sheet is a paper-based base material.

7. The package according to claim 1, wherein the intermediate sheet disposed on the uppermost heat dissipation substrate covers side surfaces of at least one heat dissipation substrate.

8. The package according to claim 1, wherein the number of the heat dissipation substrates laminated is equal to or more than two and equal to or less than six.

9. The package according to claim 1, wherein an end portion of the bag is heat-sealed.

10. The package according to claim 1, wherein the bag seals the plurality of heat dissipation substrates, the plurality of intermediate sheets, and the sheet drying agent in a vacuum state.

11. A packing box comprising:

a plurality of the packages according to claim 1; and a cushioning material provided in at least a part of a periphery of the packages in the packing box.

* * * * *